US005580018A

United States Patent [19]

Remmers

[11] Patent Number: 5,580,018

[45] Date of Patent: Dec. 3, 1996

[54] SHELF SUPPORT BRACKET

[75] Inventor: Lee Remmers, Ocala, Fla.

[73] Assignee: Clairson, Inc., Louisville, Ky.

[21] Appl. No.: 385,568

[22] Filed: Feb. 8, 1995

[51] Int. Cl.[6] ..... A47G 29/02

[52] U.S. Cl. ..... 248/235; 108/152; 211/90; 248/250

[58] Field of Search ..... 248/235, 250; 211/90, 106, 187; 108/108, 152

[56] References Cited

U.S. PATENT DOCUMENTS

| | | | |
|---|---|---|---|
| D. 346,735 | 5/1994 | Glisch et al. . | |
| 2,553,960 | 5/1951 | De Swart | 248/250 |
| 2,639,817 | 5/1953 | Ehret | 211/90 X |
| 4,603,781 | 8/1986 | Ryan, Jr. | 211/90 |
| 4,753,405 | 6/1988 | Camilleri . | |
| 5,253,837 | 10/1993 | Loux . | |
| 5,326,062 | 7/1994 | Remmers . | |
| 5,346,077 | 9/1994 | Randall . | |
| 5,351,842 | 10/1994 | Remmers . | |

*Primary Examiner*—Alvin C. Chin-Shue
*Assistant Examiner*—Derek J. Berger
*Attorney, Agent, or Firm*—Middleton & Reutlinger; Charles G. Lamb

[57] ABSTRACT

A shelf support bracket for supporting a wire shelf is of generally triangular configuration with an upper wall surface brace having a wire receiving hook at its upper most portion, a lower wall surface brace in alignment with the upper wall surface brace wherein the upper wall surface brace and the lower wall surface brace abuts and rests against a vertical wall. A transverse wire support member is spaced outwardly from the upper wall surface brace and the lower wire surface brace and is angled downwardly from the upper wall support brace so that the shelf support bracket receives a longitudinally extending wire of a wire shelf support at the upper wall surface and the transverse wire support member is engagement with two transversely extending wires of the wire shelf in an angled downwardly direction.

6 Claims, 2 Drawing Sheets

SHELF SUPPORT BRACKET

BACKGROUND OF THE INVENTION

This invention relates to a bracket for supporting a wall mounted shelf. More particularly, this invention relates to a support bracket for supporting a wall mounted shelf in an angled downwardly position.

Shelf support brackets and assemblies are well known in the art for supporting a shelf for use in storage of various items thereon. Particularly, my U.S. Pat. No. 5,351,842 teaches a shelf and support assembly which includes a bracket which is used in a shelf system wherein the shelves are removably mounted to at least two shelf support brackets in spaced relationship to support the shelf in a horizontal plane. Moreover, U.S. Pat. No. 4,753,405 teaches a support brace assembly for shelves in particular for storing shoes wherein the support brace assembly is provided with converging legs for supporting the shelf in a downwardly incline position. In U.S. Pat. No. 4,753,405 means are provided to attach the bracket to a vertical wall surface and the bracket includes spaced hook portions on a downwardly inclined leg wherein the hook portions are spaced to receive parallel longitudinally extending shelf wires or rods.

SUMMARY OF THE INVENTION

An object of the present invention is to provide a shelf support bracket which supports a shelf in an angularly downward position.

Another object of the present invention is to provide a shelf support bracket for a shelf particularly adaptable for storing shoes.

Even another object of this invention is to provide a shelf support bracket particularly adapted to be used with shelves including both longitudinally extending and transversely extending support rods or wires.

More particularly, the present invention provides a support assembly for a shelf comprising:

an upper wire surface brace portion including means to hold a longitudinally extending wire of a wire shelf;

a lower wall surface brace portion;

transverse wire support means; and, means to connect the upper wall surface brace portion to the lower wire surface brace portion and means to connect the upper wall surface brace portion to the transverse wire support means.

Further objects and advantages of this invention will appear to those skilled in the art from the following description and appended claims, reference being had to the accompanying drawings forming a part of the specification wherein like reference characters designate corresponding parts into several views.

DETAILED DESCRIPTION OF THE PREFERRED EMBODIMENT

Figure 3:
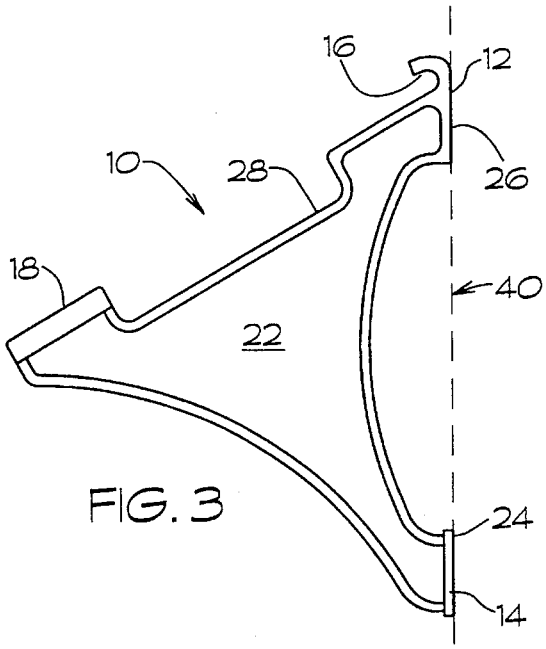
FIG. 3 is a side view of the shelf support bracket of FIG. 2 shown in a position along a vertical wall surface; and, FIG. 4 is a top view of the shelf support bracket of FIG. 3.
Figure 4:
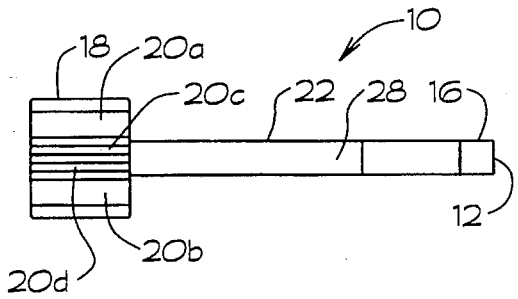
Figure 2:
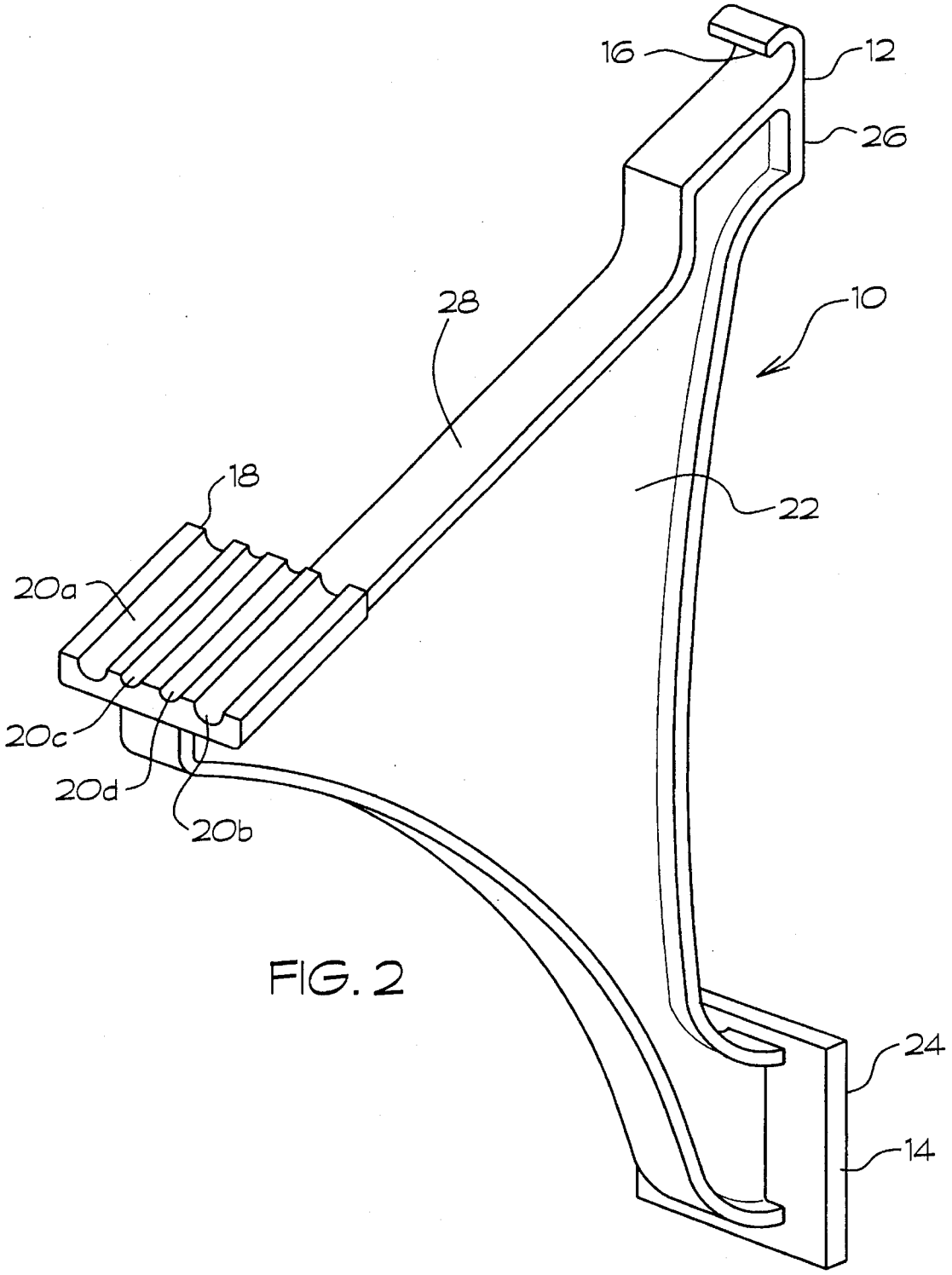
FIG. 2 is an enlarged perspective view of the shelf support bracket of FIG. 1.

Referring to the Figures, particularly FIGS. 2, 3 and 4, a self support bracket 10 of unitary construction is shown. The shelf support bracket 10 is provided with an upper wall surface brace 12 which braces the shelf support bracket 10 against the surface of the vertical wall 40. At the lower end of the shelf support bracket 10 is a lower wall surface brace 14 of generally rectangular construction which supports and rests the shelf support bracket 10 also against the wall 40.

Figure 1:
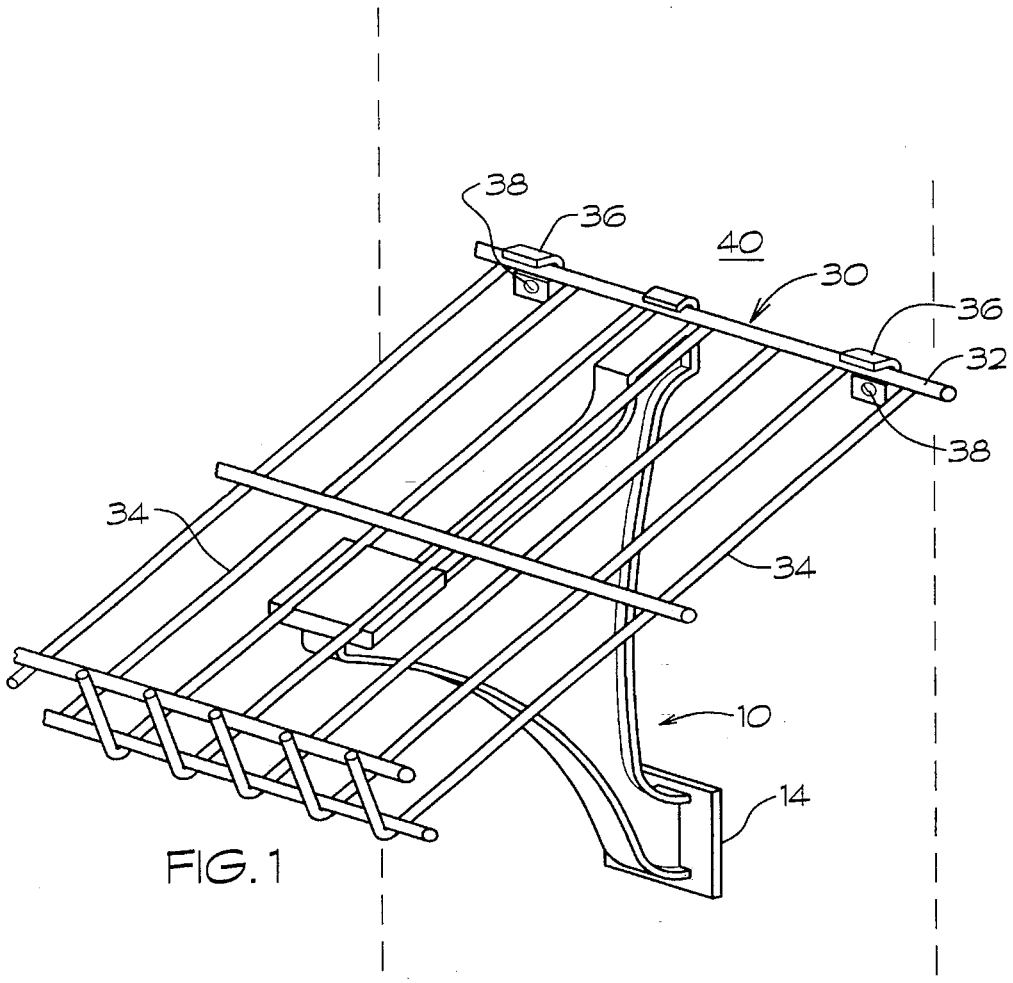
FIG. 1 is a perspective view of the shelf support bracket of the present invention shown supporting a shelf which is attached to a vertical wall surface.

At the upper most portion of the upper wall surface brace 12 is provided with an outwardly extending hook 16 attached to the vertical upper most portion of brace 12 for receiving the longitudinally extending shelf wire 32 (FIG. 1). The upper wall surface brace 12 is also provided with flat vertical wall support surface 26 for resting the bracket 10 against the wall 40. The lower wall surface brace 14 is also provided with a flat vertical wall support surface identified by the numeral 24 for abutting and resting the lower portion of the bracket 10 against the wall 40.

The shelf support bracket 10 is provided with a transverse wire support member 18 having a flat surface portion which includes at least one pair of spaced parallel grooves for receiving transversely extending shelf wires therein. Parallel grooves 20*a* and 20*b* are disposed for receiving transversely extending shelf wires 34 as shown in FIG. 1 and a second pair of parallel grooves 20*c* and 20*d* may be provided as shown in FIGS. 2 and 4 for receiving transversely extending wires (not shown) of a close mesh wire. Connecting the transverse wire support member 18 to the upper wall surface brace 12 and the lower wall surface brace 14 is a triangular shaped section 22 of the shelf support bracket 10. The triangular shaped member 22 terminates at one end at said upper wall surface brace 12, terminates at a second end 27 at said lower wall surface brace 14, and terminates at a third end at said transverse wire support member 18. The upper wall surface brace 12 and the lower wall surface brace 14 are in the same vertical plane. The triangular shaped portion 22 is provided with a cut-out 28 in the upper portion thereof which provides a spaced portion beneath the shoe support shelf 30 and in particular would be spaced from longitudinally extending shelf wires 32 if the particular support shelf for which the shelf support bracket 10 was utilized included longitudinally extending wires running beneath the transversely extending wires rather than above, as shown. Moreover, the transverse wire support member 18 is angled downwardly from the upper wall support brace 12 and is spaced outwardly and downwardly therefrom.

As shown in FIG. 1, a shoe support shelf 30 is mounted onto the vertical wall 40 by the use of wall anchors 36 wherein the wall anchors are provided with hooks therein for receiving longitudinally extending shelf wire 32 of the support shelf 30. The wall anchors 36 are mounted to the wall 40 by any well known fastener 38 for wall anchors.

In operation the shoe support shelf 30 is attached to a wall 40 by the use of wall anchors 36. The shelf support bracket 10 is then mounted to the shelf 30 by hooking the hook 16 over the longitudinally extending shelf wire 32 which is received within the hooks of the wall anchors 36. The shelf support bracket 10 is then aligned with the transversely extending shelf wires 34 and the lower wall surface brace 14 is positioned to abut or rest against the wall 40 thereby providing a support for the shoe support shelf 30 in an angularly downward position.

Preferably, the shelf support bracket 10 may be of unitary construction of a suitable resilient plastic material, one preferred resilient plastic material being polypropylene.

It is realized that various changes may be made by those skilled in the art without departing from the principals and scope of the invention as expressed in the claims appended hereto.

What is claimed is:

1. A support for a shelf bracket comprising:

an upper wall surface brace including means to hold a longitudinally extending wire of a wire shelf;

a lower wall surface brace;

transverse wire support means, said transverse wire support means including a flat surface member with two spaced parallel extending grooves therein, said spacing between said grooves being substantially the same as the spacing between transverse wires of a wire shelf, said transverse wire support means being spaced outwardly from said upper wall surface brace; and, means to connect said upper wall surface brace to said lower wall surface brace and means to connect said upper wall surface brace to said transverse wire support means.

2. The support shelf bracket of claim 1, said bracket being of unitary construction.

3. The support shelf bracket of claim 1, said means to connect said upper wall surface brace to said lower wall surface brace and said means to connect said upper wall surface brace to said transverse wire support means being a triangular shaped member terminating at one end at said upper wall surface brace, terminating at a second end at said lower wall surface brace, and terminating at a third end at said transverse wire support means wherein the upper wall surface brace and the lower wall surface brace are in the same vertical plane and the transverse wire support means is angled downwardly from said upper wall support brace.

4. The support shelf bracket of claim 1, said means to hold a longitudinally extending wire of a wire shelf being a hook attached to the vertical upper most portion of the upper wall support surface brace.

5. The support shelf bracket of claim 1, said lower wall surface brace being of a rectangular shaped vertically extending flat plate member.

6. The support shelf bracket of claim 1, said upper wall surface brace being of a rectangular shaped vertically extending flat plate member.

* * * * *